United States Patent [19]

Wernli

[11] 4,114,677

[45] Sep. 19, 1978

[54] MOLDING MACHINE FOR PRODUCING CASTING MOLDS

[75] Inventor: Max Wernli, Schaffhausen, Switzerland

[73] Assignee: Georg Fischer Aktiengesellschaft, Schaffhausen, Switzerland

[21] Appl. No.: 727,939

[22] Filed: Sep. 29, 1976

[30] Foreign Application Priority Data

Oct. 3, 1975 [CH] Switzerland ..... 12825/75

[51] Int. Cl.[2] ..... B22C 11/04; B22C 11/10

[52] U.S. Cl. ..... 164/168; 164/181; 164/183; 164/194

[58] Field of Search ..... 164/181, 169, 183, 191, 164/194, 210, 168

[56] References Cited

U.S. PATENT DOCUMENTS

| | | | |
|---|---|---|---|
| 1,661,598 | 3/1928 | Byerlein | 164/169 |
| 2,869,193 | 1/1959 | Buhrer | 164/181 |
| 3,955,614 | 5/1976 | Geiger | 164/210 |

FOREIGN PATENT DOCUMENTS

| | | | |
|---|---|---|---|
| 604,552 | 1/1935 | Fed. Rep. of Germany | 164/210 |

*Primary Examiner*—Francis S. Husar
*Assistant Examiner*—K. Y. Lin
*Attorney, Agent, or Firm*—Toren, McGeady and Stanger

[57] ABSTRACT

A molding machine for producingcasting molds has several angularly spaced molding stations and includes a main column and at least one swivel column positioned within and rotatable relative to the main column. Swivel bearings connect swivel arms to the main and swivel columns so that the arms extend transversely of and can be moved between the molding stations. Box frames for forming mold parts are secured to the free ends of the swivel arms so that they can be inverted or turned over. The swivel arms can be moved one above the other with the box frames holding mold halves which can be combined to form a complete mold.

9 Claims, 8 Drawing Figures

MOLDING MACHINE FOR PRODUCING CASTING MOLDS

SUMMARY OF THE INVENTION

The present invention is directed to a molding machine for producing casting molds. The molding machine has several molding stations and in at least one of the stations there is a compressing unit, a carrier for replaceable pattern plates, and a device for feeding molding material. Further, the machine includes a swivel unit with transversely extending swivel arms each of which support a box frame at is free end for forming half of a casting mold. The swivel arms can be moved into successive molding stations and the swivel arms can be turned by 180° so that the casting mold halves formed can be combined to provide a complete casting mold. After the formation of a complete casting mold, a reversing apparatus removes the mold from one of the molding stations and transfers it to a conveyor device.

There is known molding machines, see U.S. Pat. No. 2,325,501, which consists of two separately arranged molding devices, one producing upper mold parts and other producing lower mold parts. Each device has a swivel frame turning about a column and the frame carries molding boxes or box frames. The swivel frame is also equipped with apparatus for turning a molding box. In a station associated with both molding devices, one device is arranged for lifting the completed mold from the molding boxes for transferring the molds to a conveying device.

In this known molding machine the space requirement, which is determined by the turning circle of the swivel frames, is relatively great, and on the other hand, the insertion of cores and the checking of the casing molds for defects, particularly in the upper mold parts, is rather difficult. Furthermore, the tuning path of the swivel frames through 180° considerably impairs the working speed of the machine.

Therefore, the primary object of the present invention is to provide a molding machine of the above-described type so that the upper and lower mold halves or parts can be produced in a compact device in a series of molding stations arranged about a central swivel axis with the mold parts capable of being checked for defects, provided with cores and combined into a complete mold in the different stations and then transferred by a reversing apparatus from the machine to a conveyor. For optimizing all of the operating times, the minimum station time should be planned to correspond to a maximum partial time for the sum of all of the operating times, that is, the operating time per mold should be optimized so that the longest partial operation never determines the station time for all or at most for a part of the other operations. Likewise it should be possible, by utilizing several additional devices, to use the molding machine for different molding methods and different molding materials.

Accordingly, the problem faced in the past is solved, by providing the swivel unit with a main column rotated by a swivel drive with outwardly extending swivel arms including box frames on the main column and a turning mechanism incorporated in each swivel arm for turning the box frames. Further, at least one swivel column is mounted within and for rotatable movement relative to the main column, and the swivel column has at least one swivel arm supporting a box frame and a swivel or rotating device and a lifting device are operatively associated with the swivel column.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
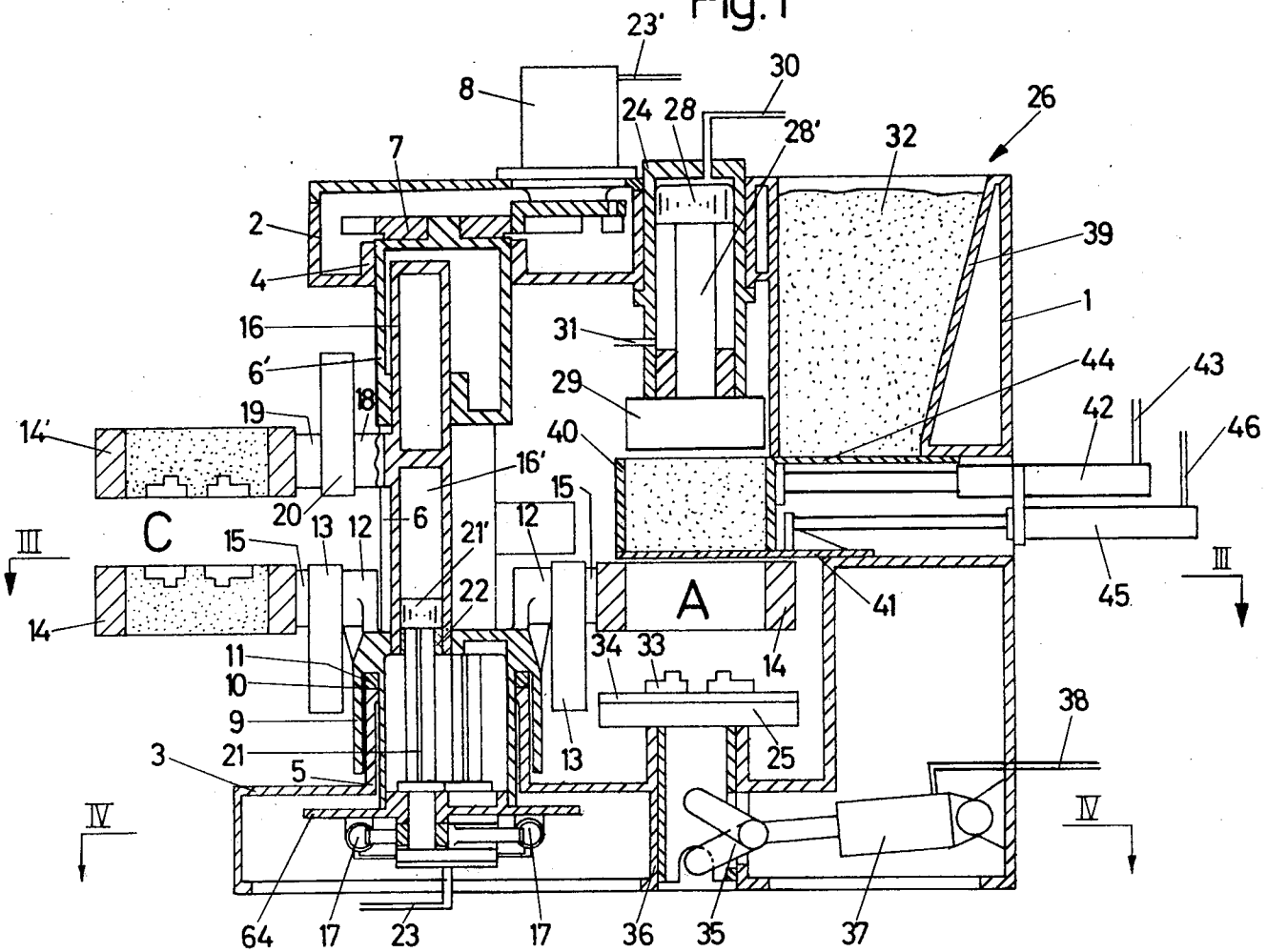
FIG. 1 is a vertical sectional view taken along line I—I of FIG. 6 with an upper mold part aligned above a lower mold part.

In FIG. 1 a molding machine is illustrated and has four molding stations A, B, C, D and includes a casing 1 with an upper part 2 and a lower part 3. A bearing 4 is provided in the upper part and another bearing 5 aligned below the upper bearing, is provided in the lower part and the bearings afford pivotal support for a main column 6. Upper bearing 4 is designed as a radial bearing and lower bearing 5 is designed as an axial and radial bearing. Main column 6 extending between the bearings 4, 5 is connected at its upper part 6' to a swivel gear 7, for example, a Maltese cross or cross wheel, propelled by a driving unit 8, for example, a fluid motor having a power feed 23'. The bottom part of column 6 is arranged as a rotor 9 and has in bearing 5 a collar 11 bearing on a ring shoulder 10 for providing guidance in the vertical axial direction. Mounted on rotor 9 in diametrically opposed relation, are swivel bearings 12 each supporting a turning mechanism 13, for example, a fluid swivel motor, and a swivel arm 15 is rotatably supported in the turning mechanism. The outer or free end of the swivel arm 15 supports a chase or box frame 14 for forming mold parts or halves. The axis of rotation of box 14 intersects the point of intersection of the diagonals of the square cavity within the box frame 14 but is displaced by a distance 12', note FIG. 6, with regard to the axis of rotation of the swivel bearing 12. The axis of rotation of swivel bearing 12 can extend both perpendicularly to the axis of column 6. With this displacement of the axes of rotation, it is possible to turn or invert box 14 about a horizontal axis through 180° by means of the turning mechanism. Such movement can be effected continuously or with intermediate stops in one of the molding stations during or after a swivel path movement by the column 6. In the embodiment displayed in FIG. 1, box 14 forms a lower mold part of half of a complete mold.

Figure 6:
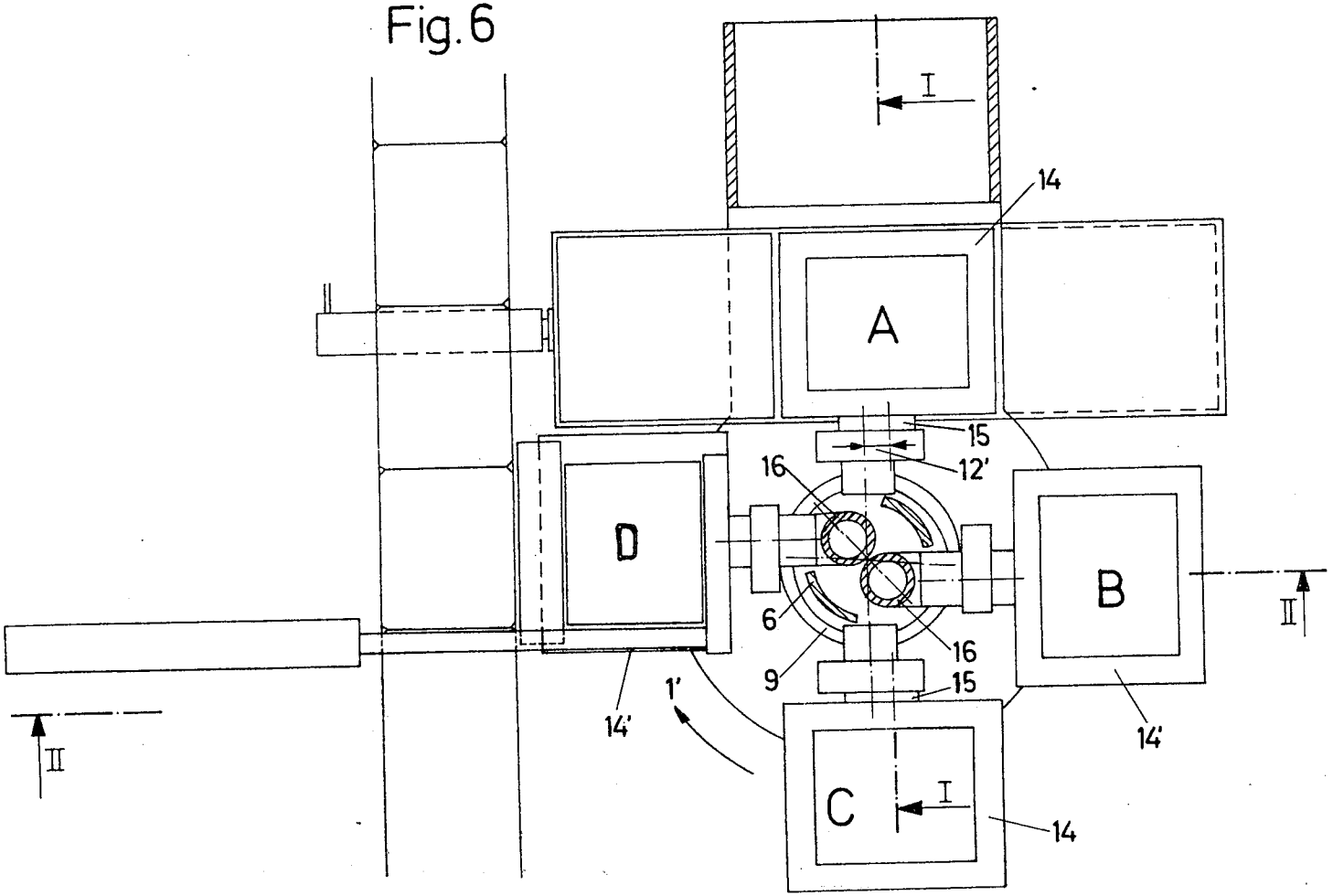
FIG. 6 is a horizontal sectional view taken along the line III—III of FIG. 1.
Figure 8:
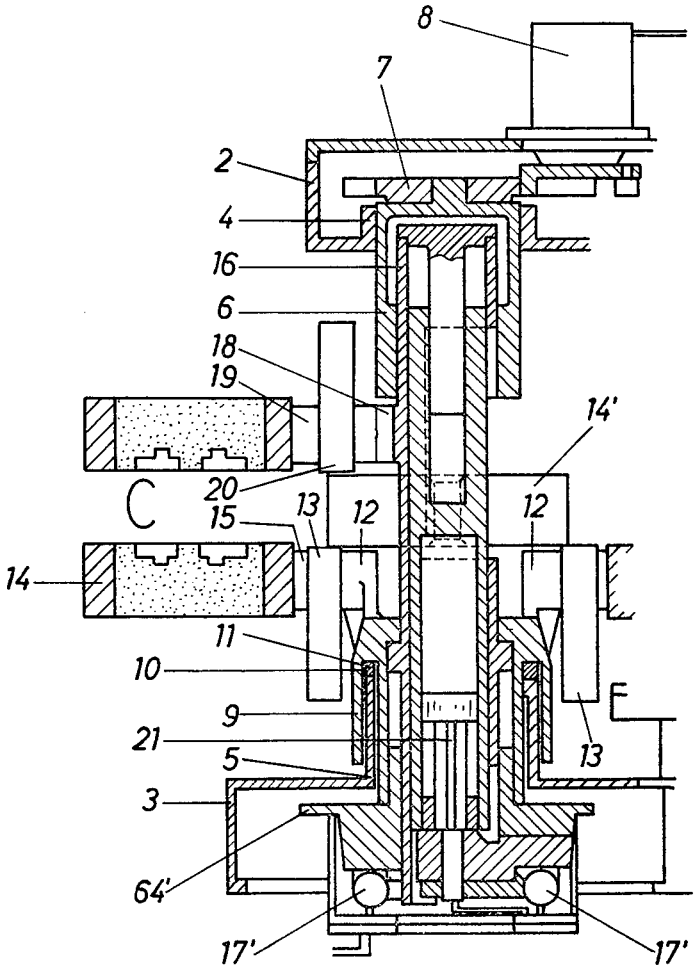
FIG. 8 is a vertical sectional view as FIG. 1, but having coaxially arranged swivel columns.

As can be seen in FIG. 6, two swivel columns 16 are arranged within the main column 6 and are parallel with and on diametrically opposed sides of the column axis of the main column. At the lower end of the machine, a swivel gear 17 is provided for rotating the swivel columns 16 either individually or jointly. Each swivel column has a fluid-operated cylinder 16' with a radially arranged swivel bearing 18. A turning mechanism 20 is mounted on the swivel bearing 18 and in turn rotatably supports a box frame-carrying swivel arm 19. As with the swivel arms on the main column, swivel arms 19 support a box frame 14' for forming a mold part or half. The axis of rotation of the box frames 14 extend through the point of intersection of the diagonals of the square sectioned cavity within the box frame and the axis is aligned with the axis of rotation of the swivel bearing 18. Swivel bearing 18 extends perpendicularly to the axis of its associated swivel column 16. Positioned within cylinder 16' is a piston rod 21 with a piston 21' at its upper end. The piston rod is connected non-rotatably with the swivel column 16, but moves in its axial direction. A driving bush 22 is located within cylinder 16' and guides the axial displacement of piston rod 21, which can be raised and lowered by means of a pressurized medium supplied to the piston rod over a line 23. The axial displacement or lift distance of the piston rod corresponds substantially to the height required for assembling the mold parts or half into a completed casting mold. Instead of the axially parallel swivel columns 16 disposed eccentrically to the main column axis, as shown in FIG. 6, swivel columns can be provided with guides extending coaxially with the main column axis. Such coaxially arranged swivel columns can be provided, as described above, with box frame carrying swivel arms and can be actuated by a swivel gear for moving the columns individually or jointly relative to the swivel movement formed by the main column. Displacement between the swivel axis of the box frame and the rotational axis of the swivel bearing is not necessary (FIG. 8).

In one of the molding stations located on the turning circle of the box frames 14,14' within the molding machine there is a molding device including a pressing cylinder 24, a pattern carrier 25 and a feeder 26 containing a molding compound 32. In the pressing cylinder 24 there is a pressing plunger 28 having a downwardly extending rod 28' at the lower end of which is a pressing plate 29 whose dimensions correspond to the dimensions of the cavity withing the box frames 14,14'. Pressing cylinder 24 is detachably mounted in casing 1 and instead of a pressing cylinder, a compressing unit selected in accordance with the molding compound and compressing method to be used can be employed, for example, a vibrating unit. The pressing plunger 28 can be raised and lowered by means of a pressurized medium supplied through the lines 30, 31.

As shown in FIG. 1, pattern carrier 25 is located below the box frame 14 and a pattern plate 34 is mounted on it and contains the patterns 33 for the mold. Pattern plate 34 is replaceably connected with the pattern carrier 25 which is inserted in a bore 36 so that it can be raised and lowered. To move the pattern carrier 25, it is provided with a lifting device, for example, a toggle lever assembly 35. The toggle lever assembly 35 is connected to a thrust position drive 37 mounted on the casing 1 for operating the assembly and the piston drive is operated by a pressurized medium supplied through a line 38.

Located laterally from the pressing cylinder 24 at molding station A is the feeding device 26. This device includes a hopper 39 for the molding material, an apportioning vessel 40 located below the hopper, and a shutter 41 closing the lower end of the vessel 40. Apportioning vessel 40 is guided in a sliding manner within the casing 1 and is connected to a displacing device 42 mounted on the casing. The displacement device can be actuated pneumatically or hydraulically by a pressurized medium supplied through a line 43. By means of the displacement device 42, the apportioning vessel 40 can be moved from below the bottom opening of the hopper 39 to a position over the box frame 14 while a drag slide 44 connected to the upper end of the apportioning vessel provides a closure for the bottom of the hopper. Shutter 41 is positioned in a horizontal guide and is connected to a pneumatic or hydraulic thrust piston drive 45 located on the casing 1 and the drive is actuated by a pressurized medium supplied through a line 46.

Ordinary foundry molding sand is used as the molding material 32. It is also possible, however, to use other molding materials, for example, cold setting molding sand. Further, different molding methods can be used and boxless casting molds or box molds can be produced depending on the design of the swivel arms and of the box frames, repsectively. In the embodiment illustrated, boxless casting molds are produced. Another possibility would be to provide interchangeable frames for the box frames.

Figure 2:
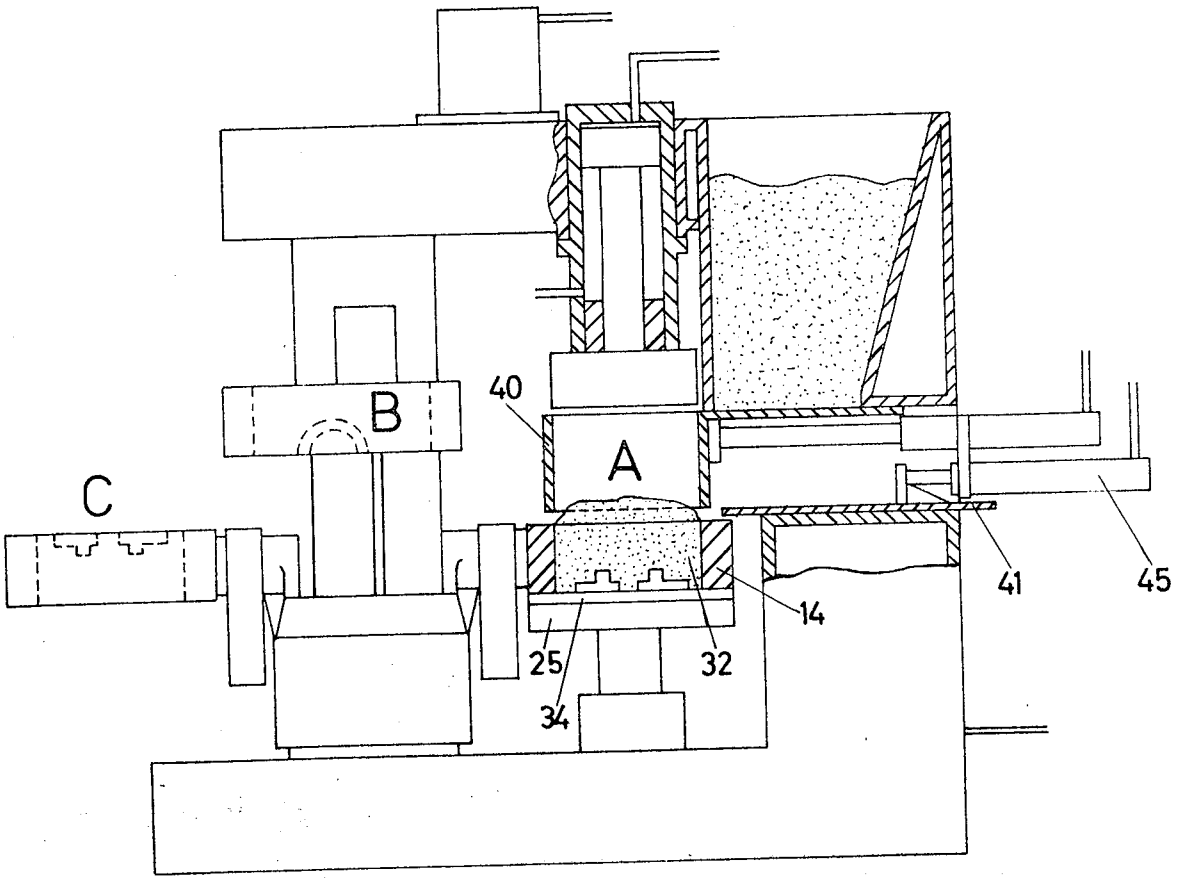
FIG. 2 is an elevational view, partly in section, illustrating a box frame in the filling position.
Figure 3:
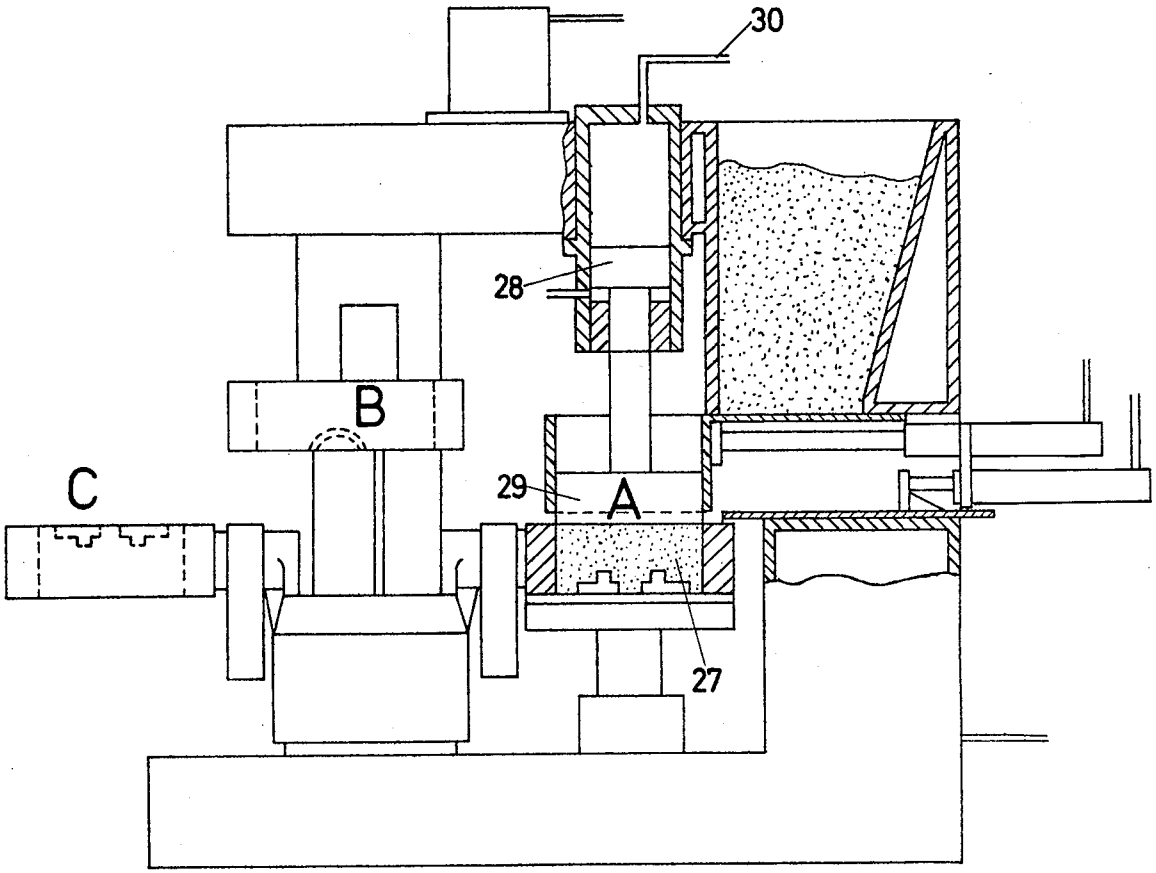
FIG. 3 is an elevational view, partly in section, and similar to FIG. 2 showing the material in the box frame being compressed.
Figure 4:
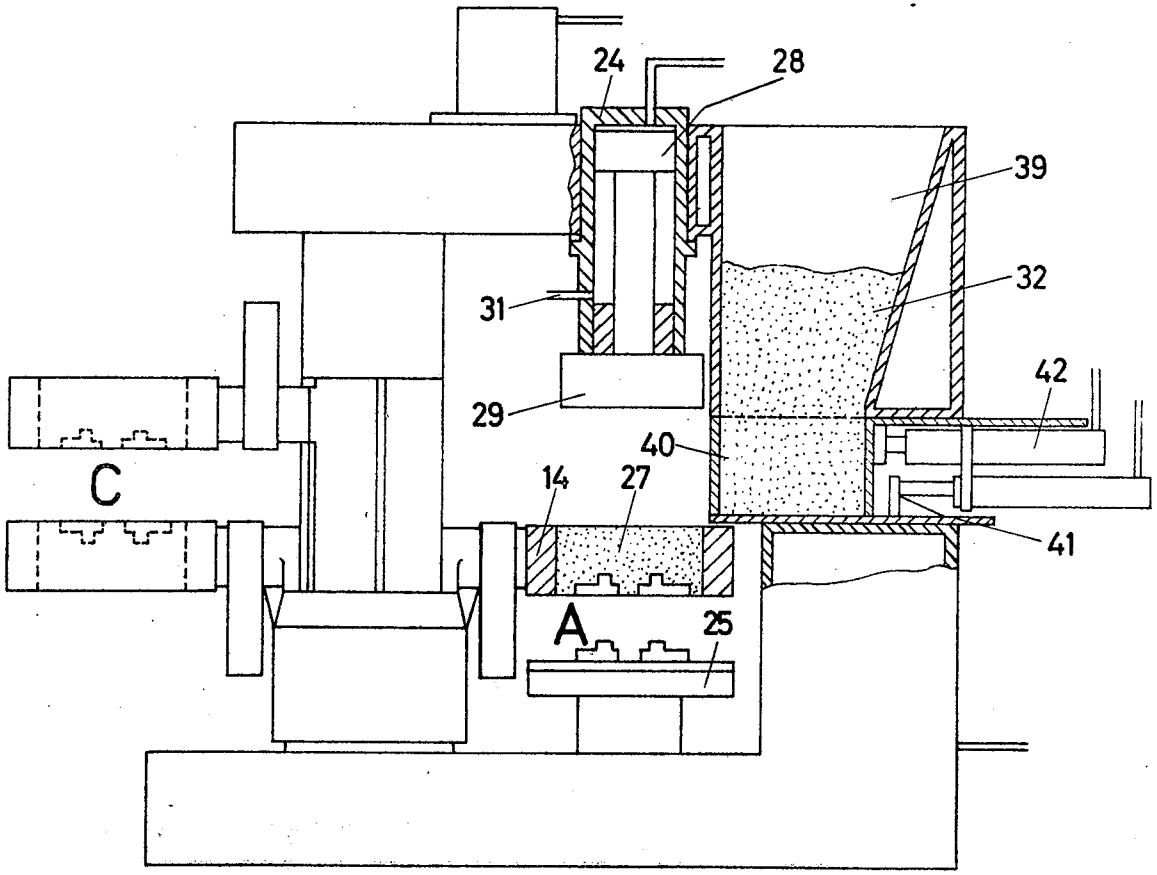
FIG. 4 is an elevational view, partly in section, and similar to FIGS. 2 and 3, however, illustrating a finished mold part.

FIGS. 2, 3 and 4 illustrate different molding operations performed by the molding machine, in FIG. 2 the molding operation is represented where pattern plate 34 supported on pattern carrier 24 is lifted against the lower end of box frame 14 and shutter 41 has been removed from the lower end of the apportioning vessel 40 so that the molding material 32 empties into the box frame whose lower end is closed by the pattern plate 34.

In FIG. 3 that portion of the molding operation is illustrated where the end of the pressing plunger 28 is supplied with pressurized medium through line 30 so that pressing plate 29 is guided downwardly toward the casting mold half 27 and compresses the molding material within the box frame.

FIG. 4 represents a further step in the molding operation with a finished mold part or half 27 held within box 14, and with the pattern carrier 25 moved downwardly from the box by means of toggle lever assembly 35 and the pressing plate 29 moved upwardly from the box by lifting the pressing plunger 28 by admitting pressurized medium through line 31. Further, apportioning vessel 40 is moved laterally out of alignment with the box 14 back into position under the hopper 39, that is, into its filling position where it can be filled with the molding material 32. Shutter 41 closes the lower end of the apportioning vessel 40, as shown in FIG. 4, so that the vessel can be filled. The amount of charge supplied corresponds to the optimum amount of molding material required for the production of a half mold. Intermediate amounts of the molding material can be obtained by varying the actuation of the shutter 41.

The representation of the other moving parts shows, for example, molding positions in producing a casting mold. These molding positions can be varied in accordance with the program of partial operations.

Figure 5:
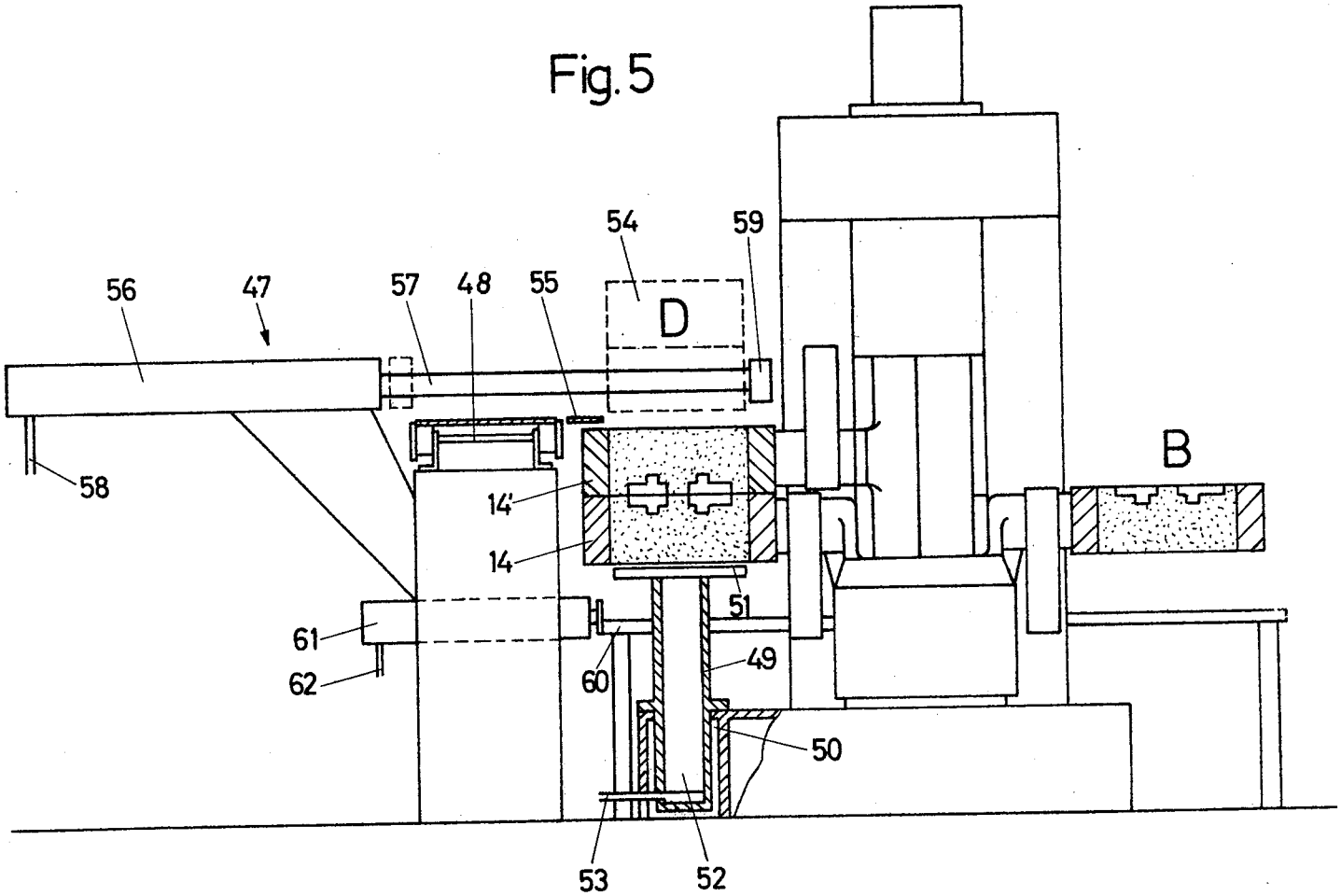
FIG. 5 is an elevational view, partly in section, taken along the line II—II of FIG. 6 with a pair of mold parts combined to form a completed mold.

In FIG. 5 the molding machine is shown with an additional station, that is a removing station containing a reversing apparatus 47 and a conveyor 48. In the removing station, a box frame 14' with a finished upper mold half is swivelled or rotated over an inverted box 14 with a finished lower mold half and both of the box frames are made to align with one another. Below the box frames 14', 14 is a centrally arranged ejection cylinder 49, detachably mounted in a receiver 50 in the casing 1. Located in the ejecting cylinder 49 is a pneumatically or hydraulically operated piston 52 having an ejection plate 51, and a pressurized medium supply line 53 is connected to the cylinder 49 for actuating the piston. By displacing the piston 52 upwardly, its ejecting plate 51 moves into contact with the bottom of the mold halves and moves them upwardly into the ejected position 54, shown in phantom. From position 54 the completed mold halves can be transferred laterally by the reversing apparatus 47 over a guide bar 55 onto the conveyor 48. Conveyor 48 can be connected directly or indirectly to a casting zone for the combined mold halves. Reversing apparatus 47 includes a stationary cylinder 56 with a piston rod 57 mounted in and extending outwardly from the cylinder and with a pressurized medium being supplied to the cylinder through line 58. The outer end of piston rod 57 has a follower 59 which embraces the casting mold for moving it from position 54 onto the conveyor. Instead of the described reversing apparatus 47, a mechanically or electrically operated device can also be used.

Changing device 60, note FIG. 5, is associated with the pattern carrier 25 for changing the pattern plates 34. The changing device 60 includes a thrust piston drive 61 actuated via a pressurized medium supplied through line 62. It is also possible, however, to design the changing device so that it is actuated by other means, for example, by an electromagnet.

Due to the possible combinations of molding operations, only a small number of pattern plates are in use, which is a determining factor for the design of the changing device 60.

FIG. 6 provides a top view of the molding machine showing the four molding stations A, B, C, D with a box frame 14 in each of stations A, C and a box frame 14' in each of stations B, D. The number of molding stations and of the box frames is not limited however, to the represented arrangement but can be increased or decreased. Further, the arrangement of the molding stations can also be varied. Swivel columns 16 located in the upper part 6' of main column 6 and rotor 8, respectively, extend eccentrically relative to the axis of the main column and are located on the angle bisector of the intersection of the lines connecting the diametrically opposed molding stations.

Figure 7:
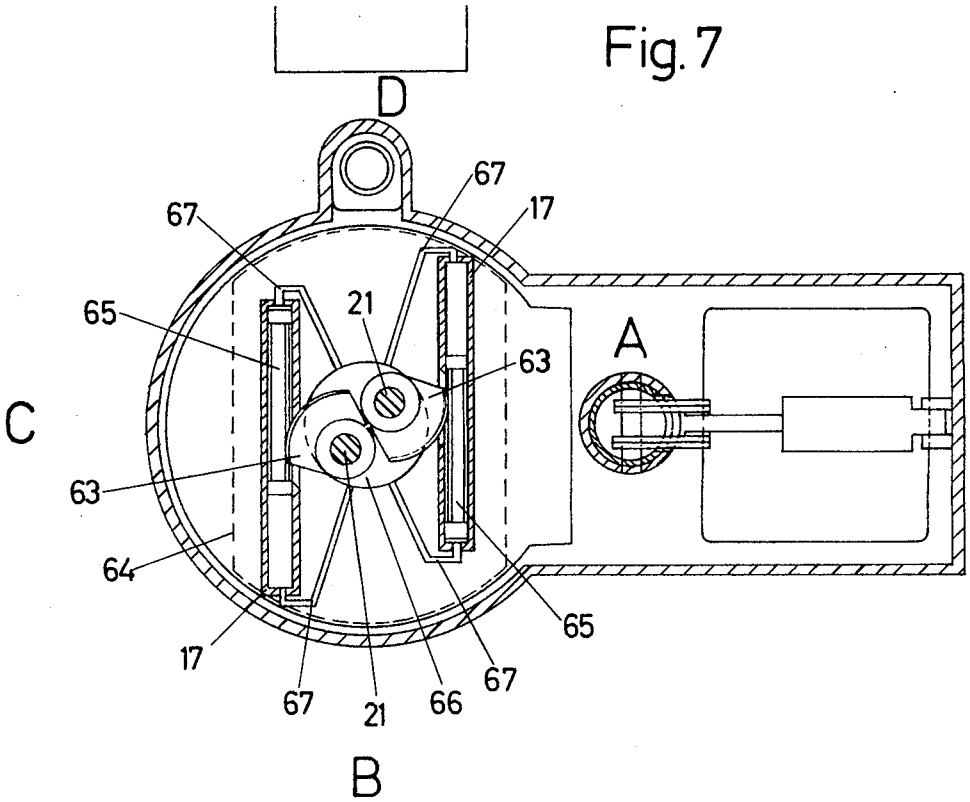
FIG. 7 is a horizontal sectional view taken along the line IV—IV in FIG. 1.

FIG. 7 provides a top view of swivel device 17 designed as a fluid swivel motor which is used for rotating the piston rods and also the swivel columns to which they are connected. Each piston rod 21 is connected to a swivel segment 63 having a toothed outer arc. The toothed arc engages a rack on a piston rod 65 inserted in a cylinder of swivel device 17 so that the swivel segment is pivoted by admitting a pressurized medium through line 67 into the cylinder. The two lines 67 are connected to a control plate 66 rotatably connected with the main column 6 and the control plate is connected to line 23, note FIG. 1, of a central control system, not shown. Piston rods 21 within the swivel columns 16, the swivel device 17 and the connecting parts of control plate 66 are mounted on a bearing plate 64 connected to the rotor 9.

Turning mechanisms 13, represented schematically in FIG. 1, can also be designed as fluid swivel motors.

Control of the described molding machine is provided by a central control system, not shown, to which all of the lines mentioned above are connected directly or indirectly.

For the description of the operation of the present invention, as viewed in FIG. 6, it is assumed that the starting position has a box frame 14 for a lower mold half positioned in station A, a box frame 14' for an upper mold half in station B, a box frame 14 for a lower mold half in station C, and a box frame 14' for an upper mold half of station D.

In this starting position, the central control system emits a pulse to actuate driving unit 37 which moves pattern carrier 25 with the patterns 33 mounted on pattern plate 34 upwardly into contact with the lower end of box frame 14 via the toggle lever assembly 35, note FIG. 2. Apportioning vessel 40 is located above the box frame with shutter 41 closing its lower end and subsequently the shutter is displaced from the lower end by time-limited actuation of the displacement device 45 opening the vessel so that an apportioned amount of the molding material 32 within it empties into box frame 14. After the molding material fills the box frame, it is compressed by actuating pressing plunger 28, note FIG. 3. Depending on the control of the displacement operation, and of apportioning vessel 40 which provides the required amount of the molding material 32, vessel 40 can be retained in alignment with the box frame during the compressing step or it can be displaced laterally from it. Following the compressing action, the pressing plunger 28 is lifted, the pattern carrier 25 is lowered and, if necessary, the apportioning vessel 40 is displaced laterally below the hopper 39. In its displaced position below the hopper, apportioning vessel 40 can be filled with molding material and is thus ready for another filling operation, note FIG. 4.

With the formation of the mold half 27 completed, as shown in FIG. 4, by a swivel movement of main column 6 in the direction of arrow 1', see FIG. 6, each of the box frames 14, 14' are moved by one angular stroke into the next successively positioned station. During such movement, by providing a further relative movement of one swivel column 16 relative to the main column 6 a box frame 14' can be moved into aligned position over a box frame 14. Depending on the program of operations, box frame 14' can also be brought in a preceding or a following relative movement of swivel column with the course of the molding operation into station A from one molding station to another to coincide with the latter. During the molding operation carried out in station A, the box frames rotated into stations B and C can be checked for form defects or can be provided with cores after they have been moved. The casting mold halves rotating into station D within the box frames 14, 14' and disposed in vertical alignment, note FIG. 5, now form a complete casting mold are lifted out of the box frames into the ejecting position 54 by actuating piston 52 which displaces the ejecting plate 51 upwardly for the displacement of the mold halves. Subsequently, the supply of pressurized medium to cylinder 56 is controlled so that the completed mold is displaced by the piston rod 57 and follower 59 from the ejected position 54 over the guide bar 55 onto the conveyor 48, from where it can be transferred to a casting zone. During continued operation of the machine, piston rod 57 is returned to the position shown in FIG. 5 and piston 52 with ejecting plate 51 is returned into its lowered starting position and the now empty box frames 14,14' are displaced in a further swivel movement of the main column 6 in the direction of the arrow by one angular stroke, that is, by the angular distance between adjacent molding stations, and pattern plate can be replaced by actuating the changing device 60, 61. From station D box frame 14 moves into station A, that is, then starting position, while box frame 14' remains in station D by a movement of swivel column 16 relative to main column 6.

Depending on the selection of the molding operations, the box frames can be turned continuously or discontinuously about the axis of rotation of the swivel arms 15,20 and can be brought into an intermediate position.

Since the box frames can be moved both individually toward and away from each other and also moved jointly within a single stroke of the swivel device, combinations of molding operations are possible in all molding methods and different molding materials can be used. Due to the compact design of the molding machine, relatively little space is required and this feature has a very favorable economical effect.

While a specific embodiment of the invention has been shown and described in detail to illustrate the application of the inventive principles, it will be understood that the invention may be embodied otherwise without departing from such principles.

What is claimed is:

1. Molding machine for producing casting molds and having several stations angularly spaced apart from one another and including a first station, a compressing unit located at said first station, a pattern carrier for replaceable pattern plates aligned with said compressing unit in said first station, said compressing unit including a compressing member movable toward said pattern carrier for compressing molding material located therebetween, and a device for feeding molding material located at said first station laterally from said compressing unit for supplying the molding material to a position between said compressing member and said pattern carrier, a swivel unit having a plurality of swivel arms connected thereto, a first box frame attached to one said swivel arm and a second box frame attached to another said swivel arm, each said first and second box frame arranged to form one-half of a casting mold, said swivel unit having an axis and being rotatable about the axis for moving said swivel arms into successive stations so that said first and second box frames can, in turn be positioned in said first station between said compressing unit and said pattern carrier for receiving molding material from said device for feeding molding material and then compressing the molding material within said box frames by the movement of said compressing unit toward said pattern carrier, at least one said first and second box frames being rotatable through 180° by said swivel arm to which it is attached for inverting one of said first and second box frames, said swivel arms being positionable so that said first and second box frames are alignable one opposite the other for forming a complete casting mold, a conveyor device spaced laterally from said stations, and means for removing a complete casting mold from one of said stations and for delivering it to said conveyor device, wherein the improvement comprises that said swivel unit includes a main column having an axis located centrally of said stations, means connected to said main column for rotating said main column about the axis thereof, the one said swivel arm mounted on and extending outwardly from said main column transversely of the column axis thereof, and a turning mechanism included in said swivel arm with said first box frame connected to said swivel arm for inverting said box frame connected thereto, at least one swivel column mounted within and extending in the axial direction of said main column, said swivel column having an axis disposed in parallel relation with the axis of said main column, means connected to said main column for rotating said swivel column about the column axis thereof relative to said main column, the another said swivel arm mounted on and extending outwardly from said swivel column transversely of the column axis thereof, and means connected to said main column for moving said swivel column in the axial direction thereof.

2. Molding machine, as set forth in claim 1, wherein two said swivel columns each having another said swivel arm are located within said main column and each said swivel column being rotatable through an angular distance relative to said main column equal to the angular distance between two adjacent said stations.

3. Molding machine, as set forth in claim 1, wherein a turning mechanism is mounted in the another said swivel arm connected to said swivel column with said box frame on said swivel arm of said swivel column arranged to be rotated about the axis of said swivel arm by said turning mechanism, and a swivel bearing mounting said swivel arm and connecting said swivel arm to said swivel column.

4. Molding machine, as set forth in claim 2, wherein two pair of said stations including said first station being spaced angularly apart with each pair of said stations being located on diametrically opposed sides of said main column, and said swivel columns being located on an angle bisector of the intersecting point of the lines connecting the axes of said pairs of diametrically opposed stations.

5. Molding machine, as set forth in claim 1, wherein at least two diametrically opposed swivel bearings being mounted on said main column, one said turning mechanism mounted in each said swivel bearing with one said swivel arm mounted on said turning mechanism, and the swivel axis of said box frame attached to said swivel arm being offset from the swivel axis of said swivel bearing.

6. Molding machine, as set forth in claim 5, wherein said main column extending vertically and said first box frames being secured to said swivel arms on said main column and forming the lower mold halves of a completed casting mold.

7. Molding machine, as set forth in claim 1, wherein said at least one swivel column being coaxial with said main column.

8. Molding machine, as set forth in claim 7, wherein said main column extending vertically, and said second box frame secured to said swivel arm on said swivel column forming the upper mold half of a completed casting mold.

9. Molding machine, as set forth in claim 3, including means connected to said turning mechanism for turning said turning mechanisms for said swivel arms on said main column and on said swivel column so that the movement thereof can be interrupted to any time.

* * * * *